US011161050B2

(12) United States Patent
Schmidt

(10) Patent No.: US 11,161,050 B2
(45) Date of Patent: Nov. 2, 2021

(54) IMMERSIVE LIVE-ACTION GAMING FACILITY

(71) Applicant: Activate Games Inc., Winnipeg (CA)

(72) Inventor: Adam Schmidt, Winnipeg (CA)

(73) Assignee: Activate Games Inc., Winnipeg (CA)

( * ) Notice: Subject to any disclaimer, the term of this patent is extended or adjusted under 35 U.S.C. 154(b) by 0 days.

(21) Appl. No.: 16/822,767

(22) Filed: Mar. 18, 2020

(65) Prior Publication Data

US 2020/0360826 A1 Nov. 19, 2020

Related U.S. Application Data

(60) Provisional application No. 62/846,912, filed on May 13, 2019.

(51) Int. Cl.

| | |
|---|---|
| ***A63G 31/00*** | (2006.01) |
| ***E04H 3/10*** | (2006.01) |
| ***A63G 33/00*** | (2006.01) |

(52) U.S. Cl.

CPC ..... *A63G 31/00* (2013.01); *A63G 33/00* (2013.01); *E04H 3/10* (2013.01)

(58) Field of Classification Search

CPC ..... A63G 31/00; A63G 31/16; A63J 11/00
USPC ..... 472/59–62, 128, 130
See application file for complete search history.

(56) References Cited

U.S. PATENT DOCUMENTS

| | | | | |
|---|---|---|---|---|
| 5,393,074 A * | 2/1995 | Bear | A63F 9/0291 273/440 |
| 8,079,916 B2 * | 12/2011 | Henry | A63G 3/02 472/128 |
| 8,574,085 B1 * | 11/2013 | Jackson | A63J 11/00 472/62 |
| 9,352,225 B2 * | 5/2016 | Ruke | A63F 13/323 |
| 2006/0258471 A1 * | 11/2006 | Briggs | A63G 31/007 472/128 |

* cited by examiner

*Primary Examiner* — Kien T Nguyen
(74) *Attorney, Agent, or Firm* — Kyle R Satterthwaite; Ryan W Dupuis; Ade & Company Inc.

(57) ABSTRACT

An immersive gaming facility has a plurality of game rooms, each with a respective interactive gaming space with electronically controlled interactive game elements, a respective entrance through which participants are admissible from a waiting area with a respective sign-in station operable to control admission of participants in a groupwise fashion. After admission, an executed game session involves controlled operation of the interactive game elements and monitoring of participant interaction therewith to identify participant completion or failure of tasks in said game session; and terminate execution of said game session upon expiry of a time limit or multiple detected failures exceeding a predetermined limit. The waiting areas are accessible independently of one another off a shared common area, allowing participation among the game rooms in any participant-selected order. The gaming spaces are darkened environments illuminated only by the interactive game elements and game status displays.

19 Claims, 3 Drawing Sheets

IMMERSIVE LIVE-ACTION GAMING FACILITY

CROSS-REFERENCE TO RELATED APPLICATIONS

This application claims benefit under 35 U.S.C. 119(e) of U.S. Provisional Application No. 62/846,912, filed May 13, 2019, the entirety of which is incorporated herein by reference, and also claims benefit under 35 U.S.C. 119(a) of Canadian Patent Applications 3,068,840; 3,068,860; and 3,068,847, each filed Jan. 20, 2020, the entireties of which are also incorporated herein by reference.

FIELD OF THE INVENTION

The present invention relates generally to amusement attractions, and more particularly to gaming facilities comprising live-action game rooms in which participants partake in an immersive live-action gaming experience.

BACKGROUND

In recent years, escape rooms have become a popular form of immersive, live-action amusement attraction, providing an alternative to more conventional indoor amusement attractions such as laser tag, and to large scale amusement parks that are cost prohibitive, particularly in smaller markets and/or those where outdoor parks are subject to seasonal constraints in climates of notable temperature variation.

At escape room facilities, visitors are admitted to a locked room and tasked with solving a series of puzzles within an allotted period of time, which if successfully solved, reveal a means of escape from the room. In some instances, instead of a singular room, the escape game spans a series of multiple rooms, where successful escape from one room enables access to a subsequent room with a new set of puzzles.

The significant popularity of such escape rooms has confirmed a hunger by the general public for alternative amusement experiences, in response to which there exists a need for new and unique immersive live-action gaming solutions.

SUMMARY OF THE INVENTION

According to a first aspect of the invention, there is provided an immersive gaming system comprising:

- a facility having a plurality of game rooms, each comprising:
  - a respective interactive gaming space inside said game room;
  - a respective entrance through which participants are admissible to the respective interactive gaming space;
  - a respective set of interactive game elements installed in the respective interactive gaming space for interaction therewith by said participants once admitted thereto;
  - a waiting area outside the interactive gaming space proximate said electronically controlled entranceway for accommodating of a group of one or more participants seeking admission to the interactive gaming space; and
  - a respective room control system comprising a respective admission control device that guides or facilitates admission to the interactive gaming space, and
  - a respective room sign-in station installed at the waiting area and configured to:
    - compile a room sign-in list composed of one or more members of said group;
    - after compilation of the room sign-in list, switch said admission control device from a first admission-denial state to a second admission-allowance state; and
    - after admission of said group to the interactive gaming space, switch the admission control device back into the admission-denial state to prevent admission of other participants into said interactive gaming space while occupied by the admitted group.

According to a second aspect of the invention, there is provided an immersive gaming system comprising:

- a facility having a plurality of game rooms, each comprising:
  - a respective interactive gaming space inside said game room;
  - a respective entrance through which participants are admissible to the respective interactive gaming space;
  - a respective set of interactive game elements installed in the respective interactive gaming space for interaction therewith by a group of one or more participants admitted thereto; and
  - a respective room control system;
- wherein the respective room control system of at least one of the game rooms is configured to, after admission of said group through the electronically controlled entranceway, perform execution of a game session involving controlled operation of the interactive game elements and monitoring of participant interaction therewith to identify participant completion or failure of tasks in said game session; and terminate execution of said game session upon a detected quantity of multiple failures exceeding a predetermined limit.

According to a third aspect of the invention, there is provided an immersive gaming system comprising:

- a facility having a plurality of game rooms, each comprising:
  - a respective interactive gaming space inside said game room;
  - a respective entrance through which participants are admissible to the respective interactive gaming space;
  - a respective set of interactive game elements installed in the respective interactive gaming space for interaction therewith by said participants once admitted thereto;
  - a waiting area outside the interactive gaming space proximate said electronically controlled entrance for accommodating of a group of one or more participants seeking admission to the interactive gaming space; and
  - a respective room control system configured to:
    - control admission of the group from the waiting area to the interactive gaming space through said entrance; and
    - after said admission of said group, perform execution of a game session involving controlled operation of the interactive game elements and monitoring of participant interaction therewith;

wherein the respective waiting area and entrance of each of the game rooms is accessible independently of the interactive gaming space of every other game room.

According to a fourth aspect of the invention, there is provided an immersive gaming system comprising:

a facility having a plurality of game rooms, each comprising:

a respective interactive gaming space inside said game room;

a respective set of interactive game elements installed in the respective interactive gaming space for interaction therewith by a group of one or more participants admitted thereto; and a respective room control system configured to perform execution of a game session involving controlled operation of the interactive game elements and monitoring of participant interaction therewith;

wherein the interactive gaming space of at least one of the game rooms is a darkened environment illuminated only by:

(a) illuminated members of the respective set of interactive game elements; and/or (b) one or more displays residing in the interactive gaming space and connected to the respective room control system to provide gameplay status information to the group during the game session.

According to a fifth aspect of the invention, there is provided an immersive gaming system comprising:

a facility having a plurality of game rooms, each comprising:

a respective interactive gaming space inside said game room;

a respective set of interactive game elements installed in the respective interactive gaming space for interaction therewith by a group of one or more participants admitted thereto; and a respective room control system configured to perform execution of a game session involving controlled operation of the interactive game elements and monitoring of participant interaction therewith;

wherein the respective room control system of each game room is operable to present a selectable replay option to occupants of the interactive gaming space upon expiration of a game session carried out therein.

BRIEF DESCRIPTION OF THE DRAWINGS

One embodiment of the invention will now be described in conjunction with the accompanying drawings in which.

DETAILED DESCRIPTION

Figure 1:
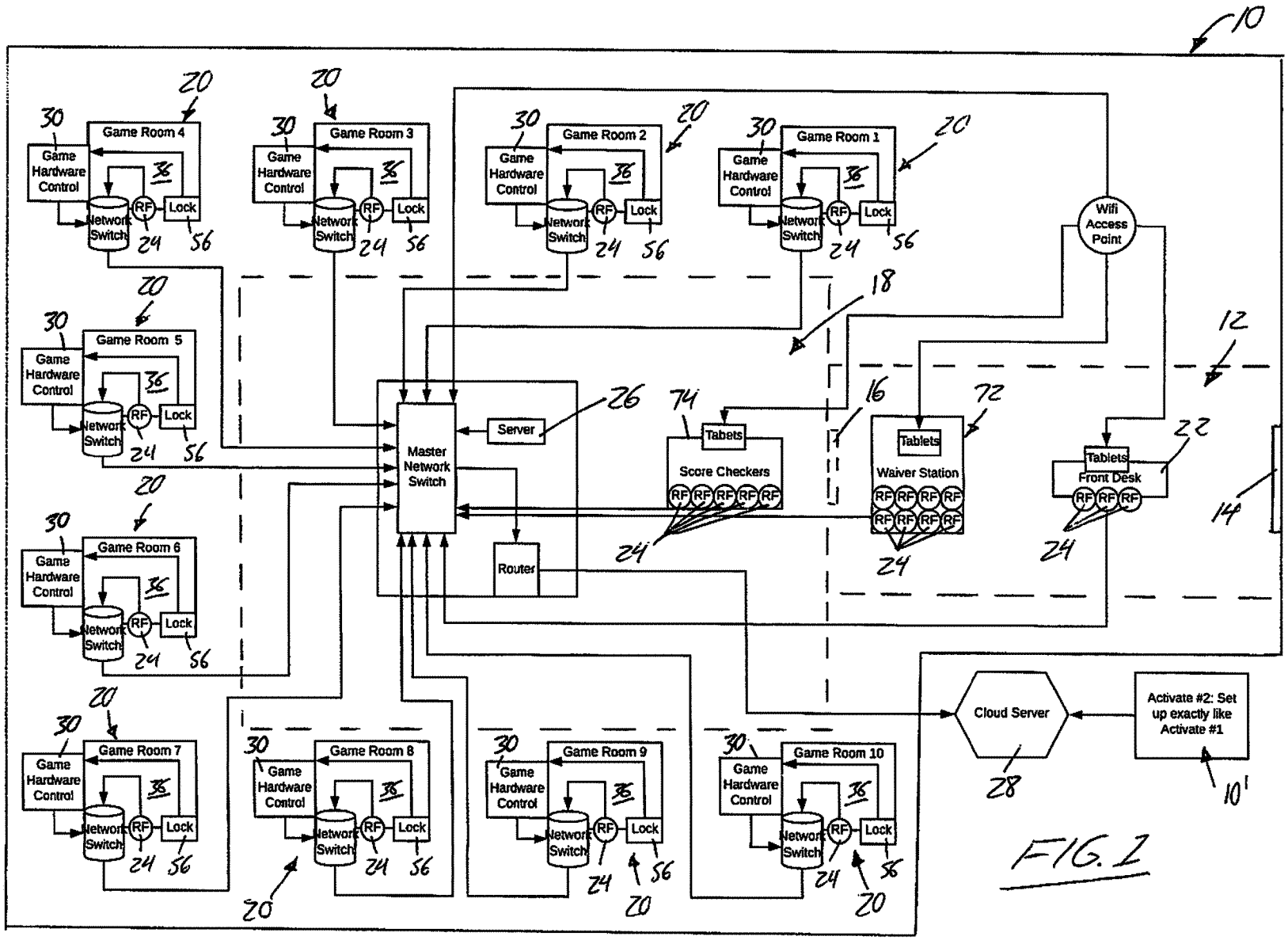
FIG. 1 is a schematic block diagram of an immersive, live-action gaming facility of the present invention, featuring a plurality of independently accessible game rooms each hosting a distinct gaming environment and each having a respective room control system for managing player admission, gameplay and departure at said room.

FIG. 1 shows a live-action, immersive, indoor gaming facility 10 according to preferred embodiments of the present invention. Visitor-accessible areas of the indoor environment of the facility include a reception area 12 that resides off a main entrance 14 of the facility, a common area 18 joined to the reception area 12 by an accessway 16, and a plurality of game rooms 20 that are all directly and independently accessible from the common area 18. Accordingly, entrance and exit to and from each and every game room 20 is gained via the common area 18, not via another of the game rooms 20. The reception area 12 features a front reception desk 22 where visiting participants are first welcomed by facility personnel, who collect payment from the visiting participants, and some embodiments, dispense facility-provided mobile devices to the visiting participants for use in wireless identification and authentication of the participants as they navigate the facility.

This mobile device carried by the visiting participant may comprise an RFID (radio-frequency identification) or NFC (near field communication) device, for example a passive RFID or NFC device storing a unique identifier thereon for reading by co-operable RFID or NFC readers distributed at various locations in the facility where identification and authentication of the participants is required. In some embodiments, the mobile device is a wearable device, such as a wristband or tag, worn on the person of the participant, but could alternatively be a card or other small item carried in a pocket of the participant. Though use of low-cost passive RFID or NFC devices lacking an onboard battery is beneficial, active devices (whether RFID-based, NFC-based, or otherwise) similarly capable of wirelessly transmitting a unique identifier to a co-operable reader may alternatively be used.

As an alternative, instead of facility-provided mobile devices, personal mobile devices (e.g. smartphones) of the visiting participants may be used for identification and authentication purposes, for example with participants downloading an app on their device that uses near-field communication (NFC) or other short-range wireless communication capabilities of the device to communicate identifying information to compatible NFC readers distributed throughout the facility. As an alternative to NFC, another means of using a smartphone or other personal mobile device for identification and authentication purposes may employ display of a scannable code (e.g. QR-code) on the screen of the mobile device for reading by optical scanners distributed throughout the facility. Similarly, such scannable codes could be used on a facility-provided wearable, card or other passive carried device as an alternative to RFID/NFC or other transmission device on the participant-carried mobile device.

As another alternative, instead of using RFID or NFC readers, or optical scanners, distributed throughout the facilities for use as identification/authentication devices, biometric scanners using fingerprint detection or facial recognition could alternatively be used to identify and authenticate users at various locations within the facility. So although the drawings feature readers 24 labeled "RF" to refer to the example of an RFID reader, the readers may be of any of the foregoing, or other known types suitable for the functional purposes described herein. Accordingly, the expression "ID reader" is used herein to refer generally to such readers.

The facility employs a computerized facility management system featuring a facility management server 26 that hosts, or is communicable with, a local participant database for storing participant profiles and associated scoring records of the participants. In the illustrated embodiment, there is also a central participant database that is hosted remotely of the facility, for example in a cloud server environment 28, and is communicable with the facility management server 26 via the internet or another wide area network so that participant profiles from the local participant database can be used to populate the central participant database. The facility management servers of additional facilities 10' can thus access and populate the central participant database, whereby a participant can attend multiple facilities and the scoring results from games played at multiple facilities can be compiled together.

Figure 2:
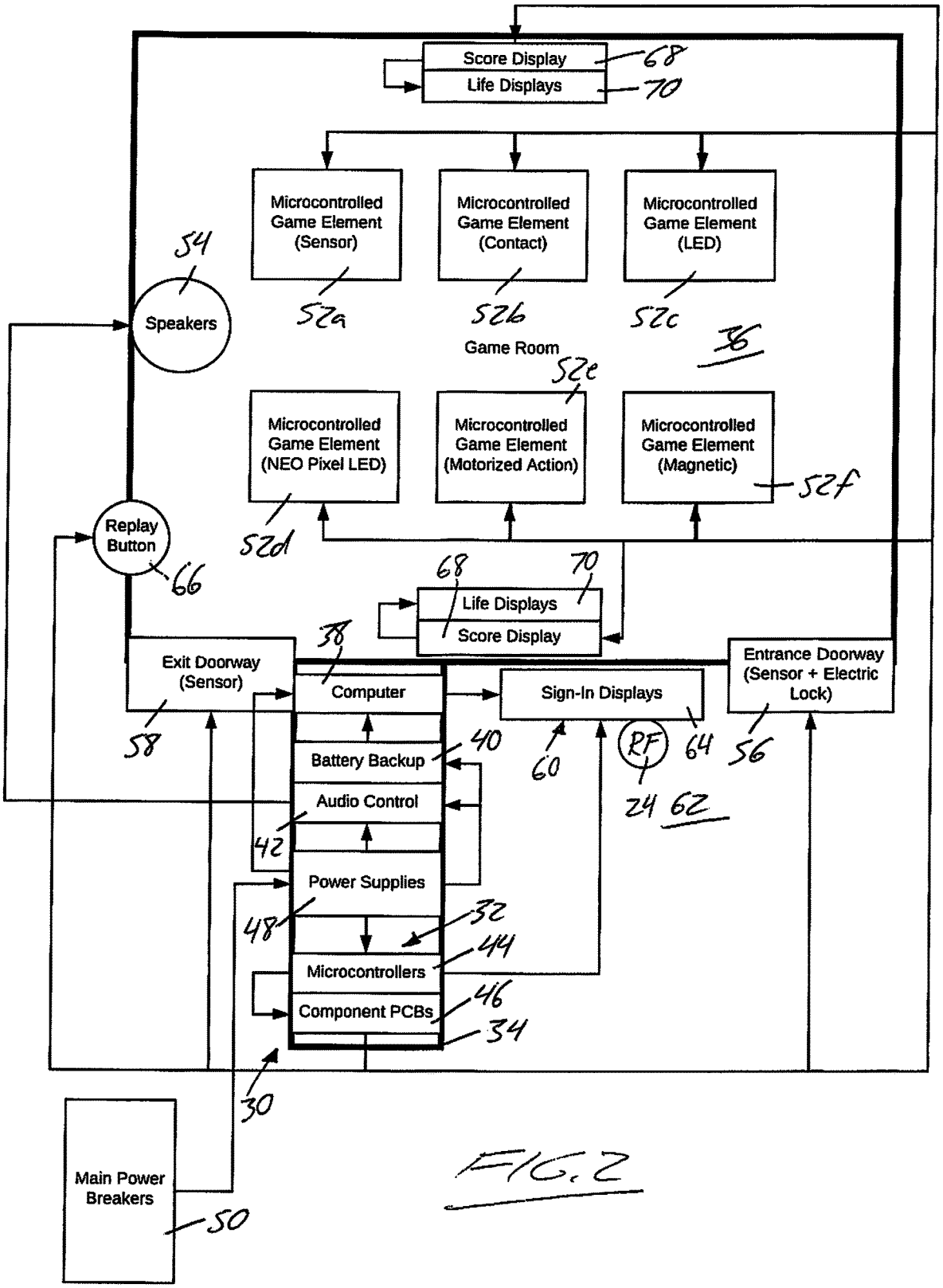
FIG. 2 is a schematic block diagram representative of each game room of the facility and the associated control system.

The computerized facility management system further comprises a respective room control system 30 for each game room 20, all of which are communicably connected to the main facility management server 26 through appropriate network switches. Each room control system 30 features a collection of control hardware 32, preferably stored in a utility closet 34 situated outside the interactive gaming space 36 of the game room 20, as shown in FIG. 2. In the illustrated embodiment, the control hardware 32 includes a local computer 38, battery backup 40, audio control components 42 including at least an audio amplifier, microcontrollers 44, component PCBs 46, and power supplies 48 through which the other control hardware components are powered via main power breakers 50 further upstream in the facility's electrical system. Based on input commands from the local computer during execution of game-control software thereon, the micro-controllers 44 drive the component PCBs of various game elements 52*a*-52*f* installed inside the interactive gaming space 36 of the room for interaction therewith by participants during gameplay. The audio control components 42 are connected to one or more loudspeakers 54 likewise installed in the interactive gaming space 36 of the room for playback of game-related audio to the participants during such gameplay.

Each game room 20 features an entranceway 56 with an electronically controlled access door or gate to enable automated locking, unlocking, closing, and optional opening, thereof. Preferably, each game room 20 also has a separate exit 58 by which participants can depart the interactive gaming space at the end of a gaming session. To ensure that entrance and exit are gained only via the entranceway and exit respectively, the doors or gates of the entranceway and exit may lack an interior handle and exterior handle, respectively, whereby the entranceway door or gate can only be opened from outside the room, and the exit door can only be opened from inside the room. For purposes described below in greater detail, the entranceway 56 and exit 58 preferably both include a sensor operable to detect passage of a participant therethrough.

The room control system 30 for each game room 20 further includes a sign-in station 60 residing near the entranceway 56 in a respective waiting area 62 situated outside the interactive gaming space 36 of the game room. The waiting areas 62 of the different game rooms may be partially sectioned off from the larger common area through which they are accessed so that a group of participants awaiting admission to a given game room in the waiting area thereof is non-obstructive to other participants walking through the common area toward other game rooms. The sign-in station 60 preferably includes a sign-in display 64 (e.g. touchscreen monitor) and one of the ID readers 24 used to identify and authenticate registered participants who wish to sign-up for participation in the interactive game space 36 of the given game room 20.

The respective room control system 30 for each game room 20 also includes a replay button 66 mounted within the interactive gaming space 36 of the room 20, for example near the exit 58 thereof, to present occupants of the interactive gaming space with a selectable replay option for restarting gameplay in the same room after termination of a prior gaming session by the same occupants. As described in more detail below, presentation of the replay option to the room occupants may be made subject to confirmation that another group of participants is not awaiting admission to the interactive gaming space 36 in the waiting area 62 outside.

The interactive gaming space 36 of each game room 20 further includes at least one performance display operable to display performance feedback to the group of participants during gameplay within said interactive gaming space, for example showing a score tally of incrementing points values during successful completion of gameplay tasks, and/or a status meter whose level is incremented or decremented in response to detected gameplay failures, similar to a life-meter or health-bar of a video game. In the illustrated embodiment, the score tally is shown on a score display 68, for example a wall-mounted flat-screen monitor, and the status meter is shown in a separate status display 70, for example in the form of a plurality of discrete illuminable indicators each representing a respective life or hit point that changes from one status to another (lit or unlit) in response to a detected gameplay failure. For example, a series of heart-shaped indicators may initially occupy a fully lit state representing a full-life or full-health status of maximum lives or hit-points, and then be turned off one-by-one in response to each gameplay failure detected in the game session, until none of the indicators are lit. Alternatively, rather than the discrete indicators being heart-shaped to denote health or livelihood when illuminated, they may be X-shaped or skull-shaped to denote health damage or loss of life, thus all starting in an unlit state and then being illuminated one-by-one in response to gameplay failures until all indicators are illuminated. Either way, once all the indicators have changed state, this denotes an early loss and early termination of the game, i.e. "game over" status.

Turning back to FIG. 1, the front reception desk 22 includes payment facilitation equipment to accept payment from visiting participants for a block of facility time. The payment facilitation equipment may be in the form of one or more tablet desktop, or laptop computers 72 running Point of Sale (POS) software and communicable with the facility management server 26 on a local wireless or wired network via a wireless access point, and with remote or cloud server 28 via the internet or other wide area network. Where RFID/NFC wristbands or other facility-provided mobile devices are employed, they may be distributed to the visiting participants at the front reception desk after payment completion. In such instances, the front reception desk features at least one of the ID readers 24, at which facility personnel scans each mobile device before handing it off to the paid participant. This is an activation scan that reads a unique identifier from the mobile device, and populates this unique identifier into an active-device database in the facility management system. Whenever a participant leaves the facility, the facility-provided mobile device is returned to the facility personnel, and then deleted from the active-device database by either a subsequent deactivation scan, or by lapse of predetermined time period. Automatic deactivation based on time lapse helps with loss prevention, ensuring that a stolen mobile device removed from the facility will not be active if brought back for attempted re-use at a later time.

A participant registration station 72 also located in the reception area 12 features a plurality of user interfaces, for example in the form of a plurality of touchscreen tablet computers or computer monitors mounted to a wall or other structure and connected to the facility management server 26 by the local network. Each computer of the registration station is connected to a respective ID reader 24. A participant having paid for and obtained a facility-provided mobile device approaches the registration station 72 and scans the mobile device at one of the ID readers 24, in response to which the user interface first checks the unique identifier of the mobile device against the active-device database. If a positive match is found, this confirms the activated (i.e. paid for) status of the mobile device, at which point the user interface prompts the participant to select either a "new player" sign-up option, or "returning player" sign-in option, or asks for a unique user ID (e.g. email address or phone number) and queries the local participant database for such user ID to automatically determine whether the participant is a new player or returning player. For new player sign-up, the participant is asked to enter user profile details (e.g. real name, user name, email address, phone number, street address, etc.), which are used to generate a new participant profile in the local participant database. The sign-up process preferably includes digital execution of a liability waiver. The newly generated participant profile created for the new player, or the existing participant profile already stored for the returning player, is assigned the unique identifier of the currently carried or worn facility-provided mobile device, whereby reading of that mobile device at any other ID reader 24 in the facility can be used to identify that participant from their stored user profile. If no positive match is found in the active-device database, then the participant is denied opportunity to sign-up or sign-in to protect the facility against use by unpaid customers. While the illustrated embodiment involves sign-up or sign-in at a separate registration station from the front reception desk where payment is made, these steps may optionally be performed at the same location. Each participant profile in the local participant database of the facility is assigned a geotag or other unique facility identifier before being copied into the central database. Accordingly, a visitor of multiple facilities completes a new registration at each facility, and the central participant database stores multiple facility-specific profiles for that visitor, each of which is tagged with the geotag or other unique facility identifier.

If personal mobile devices are used instead of facility-provided mobile device, activation at the front reception desk may instead involve loading of a unique visit-activation code onto the personal mobile device of the participant, and entry of this same code into the active-device database of the facility management system. Accordingly, optical scanning, wireless communication (e.g. by NFC) or manual entry of the visit-activation code at the registration station can then be used to authenticate the participant as a paid visitor, and enable the same sign-up or sign-in process described above. The same visit-activation code loaded onto the personal mobile device of the participant be used as the unique identifier by which the participant is identified and authenticated at the other readers of the facility during their visit, whether again by optical scanning of an on-screen representation (e.g. barcode or QR code), or by wireless radio frequency communication (e.g. NFC).

If biometrics are used instead of mobile devices, then fingerprint scanning, facial image recognition or other biometric scan may be performed for arriving participants at the front reception desk. Like the unique identifier of facility-provided mobile devices or the visit-activation code of the personal mobile devices contemplated above, the scanned biometric data, once payment for a block of facility time has been confirmed, is uploaded to an active-visitor database, whereby the new player can be authenticated as a paid customer at the registration station by scanning of their biometric feature (e.g. fingerprint or face) by a biometric reader of the registration station, and then can complete the sign-up process in the same manner described above to create a local participant profile. The biometric data resulting from each scan of the user's biometric feature thus serves as the unique identifier by which the participant is identified and authenticated at the various readers throughout the facility. Like the active device databases referenced above for mobile device embodiments, the active-user database may be wiped clean of the participant's unique identifier either upon confirmed departure from the facility, or lapse of a predetermined amount of time.

Inside the common area, there is at least one score-checking station 74 that features a number of user interfaces, for example in the form of a plurality of touchscreen tablet computers or monitors mounted to a wall or other structure and connected to the facility management server 26 and the remote/cloud server 28 via the local and wide area networks. Each computer is connected to a respective ID reader 24. Here, a participant can scan their mobile device or biometric feature, in response to which the scoring-check station computer forwards the unique identifier to the local participant database to identify the local participant profile, retrieve score information therefrom for display at the scoring-check station, and optionally retrieve stored identification information (e.g. email address) form the local participant database, which the facility management system can then use to query the central database for scoring records from other facility-specific profiles stored in the central database for that participant. The scoring information may include any one or more of the following: per-visit room scores for each game room in which the participant has participated during the current visit, a per-visit facility-wide score accumulated from among all the game rooms in which the participant has participated during the current visit, historical room scores from prior visits to the same facility, historical facility-wide scores from prior visits to the same facility, a lifetime accumulated room score for each game room has ever participated in over any number of visits to the same facility, and a lifetime accumulated facility-wide score accumulated at the same facility over any number of visits. For a participant who has visited multiple facilities, room and facility scores from the different facility-specific profiles stored in the central participant database may optionally be accessible from the score-checking station, and network-wide lifetime accumulated scores may be calculated and stored by summing the facility-wide scores from all the facility-specific profiles stored in the central database. Like the facility-specific scores, these network-wide scores may be optionally accessible from the score-checking station. The cloud server 28 may be remotely accessible to registered participants via an online portal through which those participants can log-in with their participant profile details and view all or some of the forgoing score records.

Referring to FIG. 2, game elements may include any combination of LEDs or other illuminable components, for example including one or both conventional RBG LEDs 52*c* and digitally addressable LEDs 52*d* (e.g. Adafruit NeoPixel™ LEDs); contact sensors 52*b*, for example including mechanical switches and/or capacitive touch or other touch sensors; movement sensors 52*a*, for example including LIDAR or other laser sensors, photoresistors, and/or infrared break beam sensors; motorized components 52*e*, for example employing any combination of stepper motors, servo motors, and/or linear actuator motors; and/or magnetically controlled components 52*f*. More details of particular game element implementations usable in the context of the present invention are found the Applicant's aforementioned Canadian patent applications, whose entire contents are incorporated herein by reference. In some preferred embodiments, the interactive gaming space 36 of each game room 20 is darkened environment, in which the only illumination is provided by one or more of the score display 68, status/life display 70, and game elements 52*a*-52*f*, without any other illumination source.

The local computer 38 of the game room 20 executes programmed gaming logic, during which control of the various game elements is performed through the microcontrollers and component PCBs connected thereto according to the gaming logic, and monitoring the participant interaction with game elements to detect and differentiate between successful completion and failed attempts of tasks assigned to the participants. The executed game logic may include playback of audible instructions or hints within the interactive gaming space 36 via the loudspeaker(s) 54 to aid in participant-understanding of the tasks that need to be performed to succeed in the game. The gaming logic attributes respective score values to successful completion of the different tasks, and updates the score display in the interactive gaming space 36 with incrementing score values in response to successful task completion. In response to each detected failure of a task, the status/life display is incremented or decremented accordingly. A game session is terminated by one of the following scenarios: the participants' successful completion of all the tasks within an allotted period of time, elapse of the allotted period of time with one or more of the tasks remaining incomplete, or loss of all lives/hit-points on the status meter. In the first of these scenarios, the game has been won by the participants. In the latter two scenarios, the participants have lost the game. In the instance where the game is won, the accumulated points from that game session are attributed to the score records of the participant profile of each participant that occupied the game room 20 during that game session. In one preferred embodiment, if the game is lost, the accumulated points are discarded, and not added to the score records. In other embodiments, alternative scoring methodologies may be employed.

Figure 3:
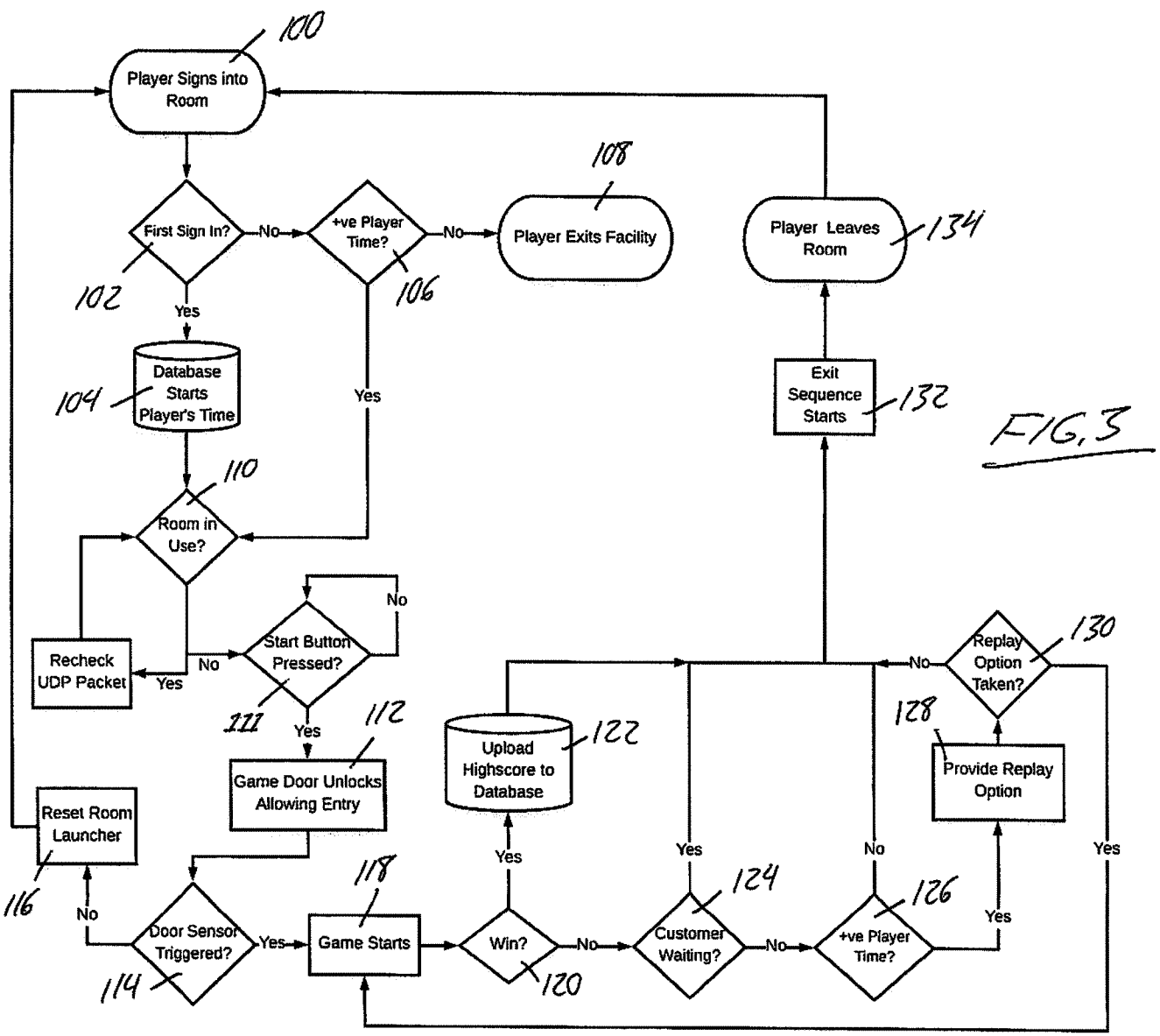
FIG. 3 is a flowchart illustrating the process by which the room control system and a cooperating facility management system manage said player admission, gameplay and player departure at each game room.

FIG. 3 illustrates the process by which a group of participants interact with any selected game room 20 they wish to participant in. At a first step 100 in the process, the group of participants arrive at the waiting area of the selected game room 20, and interact with the sign-in station 60 to request automated admission into the game room 20 by scanning their mobile device or biometric feature at the ID reader 24 of the sign-in station 60, thereby conveying their unique identifier to the local computer 38 of the room control system, which passes said unique identifier on to the facility management server 26, which, at step 102, then checks whether this is first room sign-in requested during the participant's current visit to the facility. If so, then at step 104, the current time is recorded as a start time of the block of facility time for which the participant has paid. An expiration time of the paid block is automatically calculated, and likewise stored. If it is not the participant's first room sign-in request, then at step 106, the facility management server 26 instead checks whether the paid time block has expired. Having either just started the participant's time block, or having determined that the participant's previously started time block hasn't expired, the facility management server 26 reports back to the room's local computer 38 with an authentication signal granting the participant permission to access the game room.

On receipt of such authentication, the game room's local computer 38 compiles an identity of the participant into a room sign-in list, which is displayed on the display screen 64 of the sign-in station 60, thus giving visual confirmation to the participant that they have been queued for access to the game room. These authentication steps 100, 102, 104 are repeated for each participant in the group. Should authentication fail for any participant at step 106, the display screen 64 of the sign-in station 60 displays an indication that the participant's paid time block has expired, and instructs their return to the reception area to either purchase an additional time block, or exit the facility, as shown at step 108. Once all members of the group, up to a maximum permitted number of room entrants, have been successfully authenticated and added to the sign-in list, the group requests entry to the room, for example by selection of a touch-screen start button on the sign-in station display 64. Receipt of this entry request is monitored for at step 111.

In response to the entry request, the room's local computer 38 checks, at step 110, whether the game room is already in use by another group of participants. If the room is occupied, the waiting group of participants are instructed to wait, for example by way of a "wait" command visually displayed and/or audibly emitted by the sign-in station display 64, or by a dedicated enter/wait indicator, or by a combination thereof. Once an unoccupied state of the room 20 is detected, automatic unlocking (and optional opening) of the entranceway 56 is performed, as shown at step 112, and is accompanied by display and/or audible emission of an "enter" command by the sign-in station display 64 and/or the optional dedicated enter/wait indicator. In response to this enter command, the waiting group of participants enter the interactive gaming space 36 through entranceway 56.

In one embodiment, the entranceway 56 features a manually opened door or gate, a sensor operable to detect opening thereof, and an actuator operable to close the door or gate, whereby, at step 114, the room control system monitors for opening of the door or gate, which the game control system uses as confirmation that the participants are entering the interactive game space, and therefore starts execution of a timed game session. The detected open state of the gate or door of the entranceway starts a door/gate closure countdown timer, upon expiry of which the room control system actuates the door/gate closure actuator of the entranceway 56 to close the entranceway door or gate, and electronically locks the entranceway door or gate in its closed position. As shown at step 116, if triggering of the entranceway sensor is not detected within a predetermined time limit from display of the enter command, then a reset procedure is performed to clear the room sign-up list, and restart the room sign-in procedure.

In the forgoing example, the sensor merely uses detected opening of the entranceway door or gate as feedback on the admission of participants who signed-in to the game room, without actually confirming the individual admission of each participant. In another implementation, the sensing arrangement at the entranceway may additionally or alternatively employ a sensor operable to detect passage of each participant therethrough, whereby, at step 114, the room control system monitors for a triggered state of the door sensor, counts the number of participants who walk through the unlocked entranceway in response to the enter command, and upon confirming that the number of admitted participants equals the number of participants in the sign-in list, starts execution of the timed game session, actuates the door/gate closure actuator, and electronically locks the entranceway door or gate in that closed position. Once again, if triggering of the entranceway sensor is not detected at step 116 within a predetermined time limit from display of the enter command, then a reset procedure is performed to clear the room sign-up list, and restart the room sign-in procedure.

At step 118, with admission of the group confirmed, the timed game session starts. If the group of participants successfully complete all tasks in the game session before timed expiration thereof, then at step 120, the participants are considered to have won the game, and the scored points accumulated during that game session are added to the scoring records of those participants' profiles in the local participant database, as shown at step 122. If the admitted group of participants don't win the game, whether due to timed expiration of the game session or loss of all lives/hit-points in the life status meter, then the room control system checks at step 124 whether another group of participants are awaiting admission to the same game room, i.e. whether a new sign-in list and start command have been compiled and selected at the sign-in station. If another group is not waiting, the room control system has the facility management server 26 check whether the paid time block of any current room occupant has expired, as shown at step 126. If another group is not waiting, and the room occupants have time remaining in their paid blocks, then the replay button 66 is illuminated, and an audible announcement informing the room occupants of the ability to replay the game is announced via the loudspeaker 54, thereby presenting the room occupants with a selectable replay option, as shown at step 128. Depression of the replay button by a room occupant confirms selection of the replay option at step 130, in response to which the closed and locked state of the entranceway 56 is maintained, and game replay is restarted at step 118.

If replay is not selected, or if another group was waiting and no replay option was presented, then an exit procedure is initiated at step 132. The occupants of the room depart through the exit 58, which like the entranceway, is equipped with a sensor operable to detect opening of a gate or door of the exit, and/or passage of each participant through the exit. The room control system may optionally use this sensing arrangement at the exit to count the number of participants exiting therethrough at step 134, thus more accurately confirming a fully evacuated status of the game room once the exit count equals the prior entrance count. Alternatively, evacuation status may be confirmed simply by detected opening of the exit door/gate. Either way, this confirmation serves as notice of the "available" or "unoccupied" state of the room, against which the requested access of a subsequent group awaiting admission to the room is checked at step 110.

As an alternative to checking whether each room sign-in attempt is a participant's first such request in their paid time block, and using this to signal the start of that paid time block, the accessway 16 between the reception area and common may be a restricted access point that features a reader that checks the unique identifier of the participant, confirms the active status thereof in the active-device or active-user database before allowing otherwise prohibited entry, and records the start time and automatically calculated expiration time in response to confirmation of the active device/user status. Either way, a participant's time spent in the reception area completing the registration process doesn't count against the participant's paid block of facility time, as the tracked facility time only starts counting down upon the participant's entry to the common area 18, or the participant's first entry to a game room 20.

The disclosed use of both a local participant profile database at each facility and a central participant profile database populated by the different facilities has benefits in terms of backup redundancy and ability to garner network-wide scoring records. Such redundancy allows a facility to operate in an isolated local fashion in the event of an outage or communication failure that prevents the local facility management system from communicating with the central database. The inclusion of a geotag or other facility identifier also helps prevent inadvertent overwriting of records from different facilities in the central database, for example in the instance of a sustained network outage during which a participant visits and registers at two different facilities, thus creating two facility-specific profiles with the same user-name, email address and other identifying information, which might otherwise be problematic when network communication with the central database is re-established. However, it will be appreciated that other embodiments may omit such beneficial redundancy, and may employ only a facility-specific profile database for each facility (whether locally or remotely situated) without a shared central profile database, or may employ only a shared central profile database without a set of facility-specific profile databases.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An immersive gaming system comprising:

a facility having a plurality of game rooms that are each independently accessible from a common area of said facility and that each comprise:

a respective interactive gaming space situated inside said game room and separated from said common area;

a respective entrance through which participants are admissible to the respective interactive gaming space from said common area;

a respective set of interactive game elements installed in the respective interactive gaming space for interaction therewith by said participants once admitted thereto;

for accommodating of a group of one or more participants seeking admission to the respective interactive gaming space, a respective waiting area that is directly accessible from the common area, leads into the respective entrance, and is situated outside the interactive gaming space of each and every one of said plurality of game rooms; and a respective room control system comprising a respective admission control device that guides or facilitates admission to the interactive gaming space through the respective entrance from the respective waiting area, and a respective room sign-in station installed in the respective waiting area and configured to:

compile a respective room sign-in list that is composed of one or more members of said group waiting in the respective waiting area, and that is compiled independently of any other sign-in lists compiled for any other of the plurality of game rooms by the respective room sign-in stations thereof;

after compilation of the respective room sign-in list, switch said admission control device from a first admission-denial state to a second admission-allowance state; and after admission of said one or members of the group to the interactive gaming space, switch the admission control device back into the admission-denial state to prevent admission of other participants into said interactive gaming space while occupied by the admitted one or members of the group.

2. The system of claim 1 wherein the room control system is configured to retrieve identifying information from each participant, and compile the sign-in list based on said identifying information.

3. The immersive gaming system of claim 2 in combination with mobile devices carriable by the participants and readable by the room control system to garner said identifying information from said mobile devices.

4. The immersive gaming system of claim 3 wherein the mobile devices comprise wearable devices.

5. The immersive gaming system of claim 3 wherein the mobile devices comprise RFID or NFC devices, of which a unique identifier is readable by an RFID or NFC reader of the room sign-in station.

6. The immersive gaming system of claim 1 comprising a computerized facility management system that, in addition to the room control systems, also comprises a server that hosts, or is communicable with, a participant database in which participant profiles with respective scoring records are stored, and wherein:

the respective room control system of each control room is connected to the interactive game elements to control the interactive game elements in accordance with programmed game rules, and monitor participant interaction with said interactive game elements to derive scoring results therefrom; and the server is communicable with the respective room control system of each game room to update the scoring records in the participant profiles based on said scoring results.

7. The immersive gaming system of claim 1 comprising a participant registration station configured to retrieve a unique identifier from each participant, and comprising a user-interface operable to receive sign-up or sign-in information from the participant to create or retrieve a new or existing participant profile to which the facility registration station assigns the unique identifier.

8. The system of claim 1 wherein the respective room sign-in station of each room is configured to switch the admission control device into the admission-allowance state subject to an entry request inputted thereto by a member of the group.

9. The system of claim 1 wherein the respective room sign-in station of each game room is configured to switch the admission control device into the admission-allowance state subject to a confirmed non-occupation of the respective interactive gaming space by an earlier-admitted group.

10. The system of claim 1 wherein the respective room control system comprises an audio amplifier connected to one or more loudspeakers, and is operable to convey audible instructions to the group during occupation of said interactive gaming space.

11. The system of claim 1 wherein at least one of the game rooms comprises one or more performance-related displays operable by the room control system to display performance feedback to the group during gameplay within said interactive gaming space.

12. The system of claim 11 wherein said one or more performance-related displays are operable to display a status meter whose level is incremented or decremented by the room control system in response to detected gameplay failures by the group during gameplay.

13. The system of claim 1 wherein the entrance of each game room comprises an openable/closable door or gate, and the admission control device comprises an electronic locking device which locks said door or gate in a closed position in the admission-denial state.

14. The system of claim 1 wherein the entrance of each game room comprises an openable/closable door or gate, and the admission control device comprises an actuator operable to automatically close said door or gate upon switching of said admission control device into the admission-denial state.

15. The system of claim 1 wherein the admission control device comprises a messaging device operable to visually and/or audibly convey a "wait" command in the entrance-denial state, and visually and/or audibly convey an "enter" command in the entrance-allowance state.

16. The system of claim 15 wherein the messaging device comprises a display screen of the sign-in station on which the "wait" and "enter" commands are visually displayed.

17. An immersive gaming system comprising:

a facility having a plurality of game rooms that are each independently accessible from a common area of said facility and that each comprise:

a respective interactive gaming space situated inside said game room and separated from said common area;

a respective entrance through which participants are admissible to the respective interactive gaming space from said common area;

a respective set of interactive game elements installed in the respective interactive gaming space for interaction therewith by said participants once admitted thereto;

for accommodating of a group of one or more participants seeking admission to the respective interactive gaming space, a respective waiting area that is directly accessible from the common area, leads into the respective entrance, and is situated outside the interactive gaming space of each and every one of said plurality of game rooms; and a respective room control system comprising a respective admission control device that guides or facilitates admission to the interactive gaming space through the respective entrance from the respective waiting area;

wherein the respective room control system of each game room is configured to:

independently of an occupied or unoccupied status of any other one of the plurality of game rooms, control admission of the group of participants into the respective interactive gaming space through the respective entrance from the respective waiting area, including switching of said admission control device from a first admission-denial state to a second admission-allowance state to permit entrance of said group into the interactive gaming space through the respective entrance from the respective waiting area;

after admission of said group into the respective interactive gaming space through said respective entrance from the respective waiting area switch said admission control device back into the admission-denial state and perform execution of a game session involving controlled operation of the interactive game elements and monitoring of participant interaction therewith to identify participant completion or failure of tasks in said game session; and terminate execution of said game session upon a detected quantity of multiple failures exceeding a predetermined limit.

18. An immersive gaming system comprising:

a facility having a plurality of game rooms that are each independently accessible from a common area of said facility and that each comprise:

a respective interactive gaming space situated inside said game room and separated from said common area;

a respective entrance through which participants are admissible to the respective interactive gaming space from said common area;

a respective set of interactive game elements installed in the respective interactive gaming space for interaction therewith by said participants once admitted thereto;

for accommodating of a group of one or more participants seeking admission to the respective interactive gaming space, a respective waiting area that is directly accessible from the common area, leads into the respective entrance, and is situated outside the interactive gaming space of each and every one of said plurality of game rooms; and a respective room control system comprising a respective admission control device that guides or facilitates admission to the interactive gaming space through the respective entrance from the respective waiting area, said respective game control system being configured to:

independently of an occupied or unoccupied status of any other one of the plurality of game rooms, control admission of the group from the waiting area to the interactive gaming space through said respective entrance from the respective waiting area, including switching of said admission control device from a first admission-denial state to a second admission-allowance state to permit entrance of said group into the interactive gaming space through the respective entrance from the respective waiting area; and after said admission of said group, switch said admission control device back into the admission-denial state and perform execution of a game session involving controlled operation of the interactive game elements and monitoring of participant interaction therewith;

wherein the respective waiting area and entrance of each of the game rooms is accessible independently of the interactive gaming space of every other game room.

19. An immersive gaming system comprising:

a facility having a plurality of game rooms that are each independently accessible from a common area of said facility and that each comprise:

a respective interactive gaming space situated inside said game room and separated from said common area;

a respective entrance through which participants are admissible to the respective interactive gaming space from said common area;

a respective set of interactive game elements installed in the respective interactive gaming space for interaction therewith by said participants once admitted thereto;

for accommodating of a group of one or more participants seeking admission to the respective interactive gaming space, a respective waiting area that is directly accessible from the common area, leads into the respective entrance, and is situated outside the interactive gaming space of each and every one of said plurality of game rooms; and a respective room control system comprising a respective admission control device that guides or facilitates admission to the interactive gaming space through the respective entrance from the respective waiting area;

wherein the respective room control system of each game room is configured to:

independently of an occupied or unoccupied status of any other one of the plurality of game rooms, control admission of the group of participants into the respective interactive gaming space through the respective entrance from the respective waiting area, including switching of said admission control device from a first admission-denial state to a second admission-allowance state to permit entrance of said group into the interactive gaming space through the respective entrance from the respective waiting area;

after admission of said group, switch said admission control device back into the admission-denial state and perform execution of a game session involving controlled operation of the interactive game elements and monitoring of participant interaction therewith;

upon expiration of said game session, check whether another group of participants is awaiting admission to the respective interactive gaming space, and conditional on confirmed lack thereof, present, within the respective interactive gaming space, a selectable replay option to occupants of the interactive gaming space; and in response to occupant selection of said reply option, perform execution of another game session within said interactive gaming space without first switching said admission control device back into the admission-allowance state.

* * * * *